US006168335B1

(12) United States Patent
Mears et al.

(10) Patent No.: US 6,168,335 B1
(45) Date of Patent: Jan. 2, 2001

(54) APPLICATOR AND DISPENSING DEVICE USING SAME

(75) Inventors: Christopher Mears; Richard F. Gray, both of New York, NY (US)

(73) Assignee: Arich, Inc., New York, NY (US)

( * ) Notice: Under 35 U.S.C. 154(b), the term of this patent shall be extended for 0 days.

(21) Appl. No.: 09/135,942

(22) Filed: Aug. 18, 1998

(51) Int. Cl.[7] ..... A46B 11/02
(52) U.S. Cl. ..... 401/190; 401/118
(58) Field of Search ..... 401/190, 118, 401/143, 187, 188

(56) References Cited

U.S. PATENT DOCUMENTS

| | | | | |
|---|---|---|---|---|
| 2,941,696 | | 6/1960 | Homm . | |
| 3,451,593 | | 6/1969 | Dillarstone . | |
| 3,595,440 | | 7/1971 | Prussin et al. . | |
| 3,608,781 | | 9/1971 | Flynn . | |
| 3,960,160 | | 6/1976 | Hogan . | |
| 3,961,635 | * | 6/1976 | Miya | 401/190 |
| 3,964,501 | | 6/1976 | Matchett . | |
| 4,057,901 | | 11/1977 | Bloem . | |
| 4,121,602 | | 10/1978 | Young . | |
| 4,277,193 | | 7/1981 | Knaus . | |
| 4,294,270 | | 10/1981 | Cochran . | |
| 4,376,441 | | 3/1983 | Duncan . | |
| 4,388,936 | | 6/1983 | Roberts . | |
| 4,516,591 | | 5/1985 | Hierholzer . | |
| 4,605,026 | | 8/1986 | Nolin . | |
| 4,691,720 | | 9/1987 | Schmitz . | |
| 4,692,047 | | 9/1987 | Endo . | |
| 4,773,562 | | 9/1988 | Guret . | |
| 4,799,456 | * | 1/1989 | Young | 401/190 |
| 4,934,855 | | 6/1990 | Recchelbacher . | |
| 4,958,647 | | 9/1990 | Busch et al. . | |
| 5,167,347 | | 12/1992 | Wiegner et al. . | |
| 5,289,835 | | 3/1994 | Harlan et al. . | |
| 5,289,944 | | 3/1994 | Wiegner et al. . | |
| 5,291,905 | | 3/1994 | Busch et al. . | |
| 5,311,887 | | 5/1994 | Ramsey . | |
| 5,337,764 | | 8/1994 | McKay . | |
| 5,339,839 | | 8/1994 | Forcelledo et al. . | |
| 5,483,979 | | 1/1996 | Bertieri . | |

FOREIGN PATENT DOCUMENTS

| | | | | |
|---|---|---|---|---|
| 0778225A2 | | 10/1996 | (EP) . | |
| 1353494 | * | 11/1962 | (FR) | 401/190 |

OTHER PUBLICATIONS

Hoyu Company Ltd. Hair coloring package and associated information from *Spray Technology& Marketing*, Jul. 1997.

* cited by examiner

*Primary Examiner*—David J. Walczak
(74) *Attorney, Agent, or Firm*—Venable Law Offices

(57) ABSTRACT

A dispensing device is detachably mountable atop a plurality of valved containers containing constituents under pressure which are dispensed upon actuation of the container valves. The dispensing device comprises a mixing chamber for mixing together the constituents dispensed from the containers to form a mixed product and for outputting the mixed product through plural outlet ports, an applicator having a plurality of tines at least some of which are hollow, the hollow tines being in fluid communication with respective outlet ports of the mixing chamber for dispensing from distal ends thereof the mixed product, and an actuator for simultaneously actuating the container valves. The mixing chamber has an inlet port for admitting the constituents dispensed from the containers into the mixing chamber, and an elongated tortuous flow path having one end communicating with the inlet port and another end communicating with the plural outlet ports. The tortuous flow path has a sinuous or spiral shape effective to thoroughly intermix the constituents during flow thereof from the inlet port through the tortuous flow path to the outlet ports.

21 Claims, 6 Drawing Sheets

APPLICATOR AND DISPENSING DEVICE USING SAME

FIELD OF THE INVENTION

The present invention relates to an applicator for dispensing and applying fluid products to a desired object, and to a dispensing device for mixing and dispensing fluid components under pressure from a plurality of containers to provide a combined multi-component product that may be directly applied to a desired object.

BACKGROUND INFORMATION

It has long been known to dispense a single-component fluid product under pressure from an aerosol or pump-type container or the like. Various types of dispensers are also known which are capable of dispensing a multi-component product by means of the ejection and mixing of two different fluid constituents from separate containers. For example, U.S. Pat. No. 4,773,562 discloses a dispenser of the latter type, which is used for dispensing a two-component self-heating shaving cream comprising a first component including a reducing agent and a second component including an oxidizing agent reactive with the reducing agent to liberate heat.

Dispensing devices that provide for the simultaneous release of materials from two containers in response to the pressing of a valve release button or actuation of a pump generally include tubes, ducts, or similar structure for conveying each of the two materials from the respective containers to a mixing chamber at which the materials are combined, the mixing chamber having a single outlet port or nozzle at which the mixture is dispensed. In U.S. Pat. No. 4,773,562, for example, a dispensing head is provided with a Y-shaped groove having lateral arms for separately conveying materials dispensed from two different containers to a median arm, where the two materials are mixed and conveyed as a combined product to a single outlet nozzle.

Various types of applicator structures are also known which are formed on, or mountable to, a single pressurized dispensing container for converting a stream of a dispensed product into a form more useable for a given application. In the hair care field, for example, one type of known applicator consists of an appliance having a comb or brush type structure mountable on a pressurized dispensing container. This type of device has internal conveying means for conveying a hair treatment fluid from a nozzle of the pressurized dispensing container to one or more outlet ports to enable the direct application of the hair treatment fluid to the user's hair. This type of device has been made available for use with products such as shampoo, conditioner, styling formula, and hair dye to enable one-hand use and easy manipulation by a consumer or stylist.

However, in fluid application processes requiring the use of a multi-component product that must be mixed immediately before application to a given object, none of the known devices is capable of dispensing, mixing and applying such products in a satisfactory manner. For example, in the use of multi-component hair dye products, the user or stylist is generally required to carefully perform a number of manual operations to properly mix the individual components before applying the mixture to the hair. This series of operations commonly includes steps of transferring a chemical dye agent from a first container into a second container containing an activating agent to produce a mixture, removing an applicator from the second container to permit proper outgassing of the mixture, sealing the second container, shaking or agitating the second container containing the mixture to assure proper mixing of the chemical agents, unsealing the second container, reinstalling the applicator on the second container, applying the mixture to a selected portion of the hair to be treated, and dispersing the mixture throughout the hair to ensure an even application of the dye. During the performance of each of the foregoing steps, the consumer or stylist is usually required to wear safety gloves to prevent staining of the hands, clothing and surrounding area. However, since the safety gloves become covered with the dye, the problem of staining is seldom avoided.

The series of operations required in the use of conventional multi-component hair dying systems are not only awkward, dirty and inconvenient, but are disadvantageous from the standpoint of safety. Moreover, outgassing of the mixture is generally accompanied with unpleasant odors associated with harmful chemicals.

SUMMARY OF THE INVENTION

In view of the foregoing disadvantages of the prior art, an object of the present invention is to provide a dispensing device for controlling the coordinated mixing and dispensing of a plurality of fluid constituents.

Another object of the present invention is to provide a novel and improved dispensing device for mixing together a plurality of fluid constituents and directly applying the mixture to a desired object.

Still another object of the present invention is to provide a novel and improved dispensing device simple in manufacture and which may be easily cleaned by the consumer, in which a plurality of fluid constituents may be kept under pressure in separate reservoirs until immediately prior to use, and which releases the constituents in a controlled manner for mixing and discharge.

Yet another object of the present invention is to combine a dual-component dispensing device for the mixing and dispensing of two fluid constituents with an applicator for directly applying the mixture of fluid constituents to a desired object and dispersing the mixture over the surface of the object.

Still yet another object of the present invention is to provide a novel and improved hair care accessory for use in mixing and dispensing a plurality of fluid hair care products and which has an applicator with a plurality of tines arranged in a matrix for directly applying and dispersing the mixture throughout the hair without the need for wearing safety gloves.

A further object of the present invention is to provide an applicator having tines or teeth, some of which have internal ports connectable to a source of product to be dispensed, for uniformly applying the product to a desired object, such as a person's hair.

Another object of the present invention is to provide an applicator having internal passageways which are connected at one end to a source of product to be dispensed and which are connected at their other end to internal ports formed in tines or teeth on the applicator to enable dispensing of the product through the tines or teeth.

In order to achieve the foregoing objects as well as others which will be readily apparent to those of ordinary skill in the art, the present invention proposes a dispensing device capable of mixing, dispensing and applying a plurality of fluid constituents. The dispensing device of the present invention is intended for use with a plurality of individually valved fluid containers containing fluid constituents, the dispensing device comprising a mixing chamber having a plurality of inlet ports for receiving the individual fluid constituents discharged from the containers and a mixing passageway for mixing together the fluid constituents, and an applicator having one or more fluid outlet ports for dispensing and applying the constituent mixture to a desired object. The dispensing device permits the coordinated mixing, dispensing and application of a plurality of fluid constituents to a desired object in a single, easily-manipulable operation which may be performed by a one-hand operation without the need for wearing safety gloves.

In the case of multi-component hair dye systems, for example, the applicator is preferably in the form of a comb matrix having internal passageways for conveying the mixture from the mixing chamber to the one or more outlet ports. Selected ones of the tines or teeth of the comb matrix are preferably hollow with an opening at the distal end thereof for dispensing the mixture onto the hair. The tines or teeth of the comb matrix are used to dispense and apply the mixture throughout the hair to produce a uniform coating of the hair dye throughout the user's hair.

Preferably, the applicator and the mixing chamber are provided in the form of an applicator head that may be mounted on a pair of independent aerosol-type containers by means of a snap-fit or frictional engagement. In a preferred embodiment, the containers comprise aerosol-type containers each having a first compartment containing one of the constituents of a two-constituent mixture and a second compartment containing a propellant for dispensing the constituent upon the pressing of a valve release member. The applicator head has a depressible button-type valve release member for simultaneously pressing the valve stems of the aerosol-type containers to discharge the constituents from the containers for delivery to the mixing chamber.

Alternatively, the containers may be independent pump-type containers each having a single reservoir containing one of the constituents of the two-constituent mixture, and a pump mechanism for dispensing the constituents upon the activation of a pumping member. The applicator head has a depressible button to effect the simultaneous activation of the pumping members of the pump-type containers.

In order to facilitate ease of manufacturing and cleaning, the applicator head including the applicator and the mixing chamber are preferably formed of two complementary parts fitted together, including a first part provided with means adapted to cooperate simultaneously with valve actuating elements of the fluid containers for causing the ejection of the constituents of the containers into respective inlet ducts leading to the mixing chamber. The mixing chamber effects intermixing of the constituents and delivers the mixture through a plurality of outlet ports to the applicator.

To obtain proper mixing of the fluid constituents, the mixing chamber is preferably shaped to provide a mixing passageway in the form of a tortuous flow path for the flow of the fluid constituents between the meeting point of the two constituents in the mixing chamber and the plurality of outlet ports, thereby ensuring a thorough and uniform intermixing of the two constituents. Preferably, a sinuous flow path or a spiral flow path is utilized to obtain the desired intermixing flow, such path being obtained by at least one baffle carried by at least one of the first and second parts which constitute the mixing chamber.

The outlet ports of the mixing chamber are preferably disposed in an open, unobstructed portion of the mixing chamber disposed at the end of the tortuous flow path. Preferably, the applicator is disposed adjacent to the mixing chamber and has a plurality of dispensing tubes extending from the outlet ports of the mixing chamber for dispensing the mixture onto a desired object.

The applicator may be provided with a surface effective for the direct application of the mixture to a desired object. In the case of a hair care appliance, for example, the applicator is preferably provided in the form of a comb matrix, the plurality of dispensing tubes serving as tines or teeth of the comb matrix.

The fluid constituents are conveyed from the containers to the inlet ports of the mixing chamber through passageways which may be constructed to provide an identical path length for the two flows from the containers to the mixing chamber, or, may be shaped so as to provide different length paths for the two flows, depending upon the characteristics and viscosity of the respective fluid constituents.

DETAILED DESCRIPTION OF THE PREFERRED EMBODIMENTS

Embodiments of the dispensing device according to the present invention will be described by way of example with reference to a hair treating appliance. The invention is not, of course, so limited to a hair treating appliance and extends to, encompasses and covers dispensing devices for mixing and dispensing virtually all types of fluid constituents. As used herein, the term "constituent" means the contents within one container which is to be mixed and dispensed with the contents of one or more other containers without regard to the number of individual ingredients making up the constituent. As used herein, the term "fluid constituent" means a constitutent having sufficient fluidity to be flowable and dispensed from a container and includes liquids, gases, entrained powders and the like.

Figure 3:
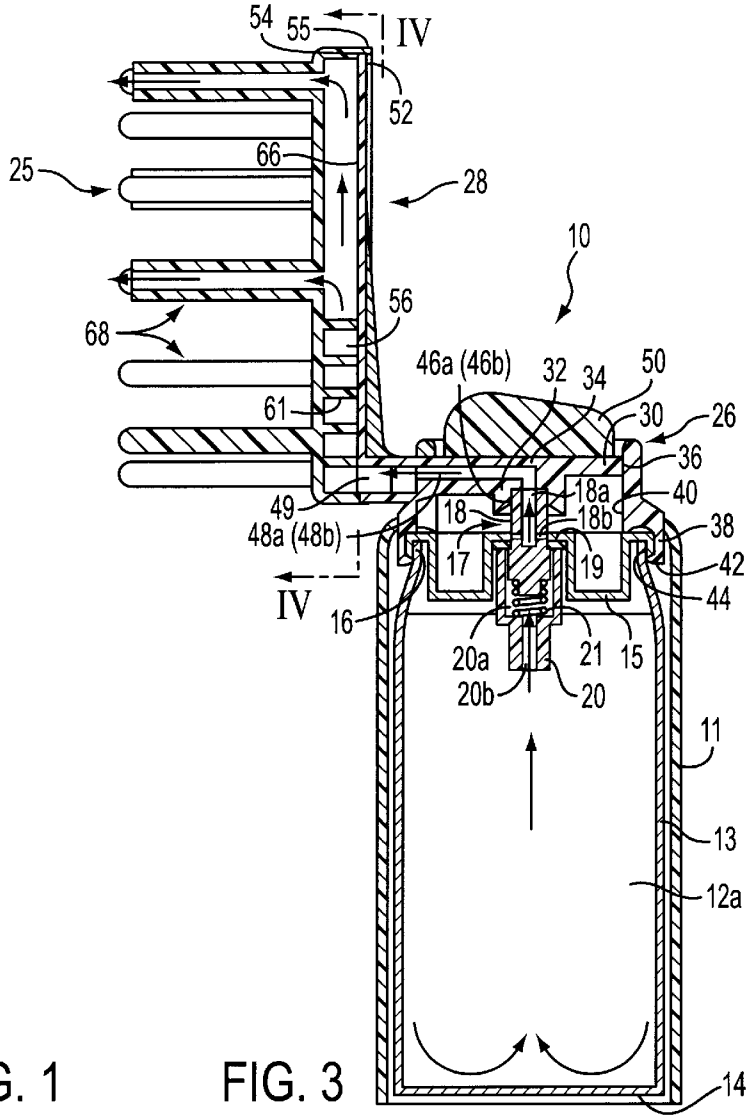
FIG. 3 is a side cross-sectional view of the dispensing device of FIGS. 1 and 2, taken along line 3-3 of FIG. 2, so as to illustrate the cross-section of the fluid reservoirs and the lower portion of the applicator head along a center line of the fluid reservoirs, and to illustrate the crosssection of the upper portion of the applicator head at a center line thereof.
Figure 1:
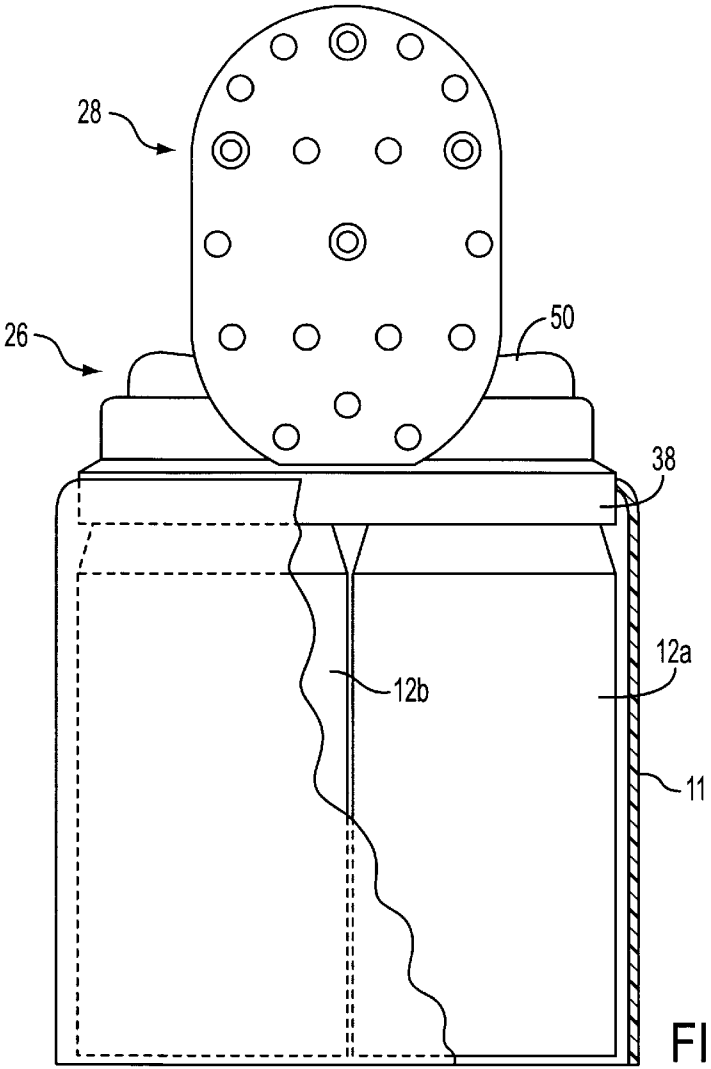
FIG. 1 is a front elevational view of a dispensing device according to a first preferred embodiment for the dispensing of doses of a product resulting from the mixing in a mixing chamber and dispenser head of two different constituents, each contained in a fluid reservoir.
Figure 2:
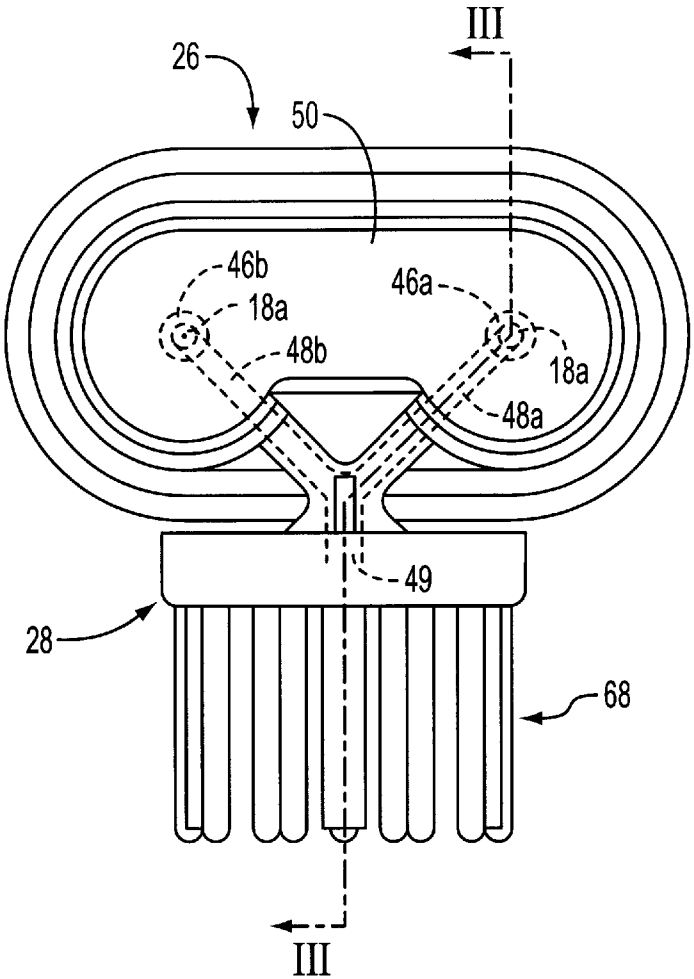
FIG. 2 is a top elevational view of the dispensing device of FIG. 1.

One embodiment of a dispensing device 10 in the form of independent a hair treating appliance is shown in FIGS. 1–3. The dispensing device 10 is removably attachable to a pair of containers 12*a*,12*b* and is operable, when actuated, to effect the simultaneous ejection of the constituents of the two containers, convey the constituents to a mixing chamber wherein the constituents are uniformly intermixed and delivered to an applicator for dispensing the constituent mixture. The two containers 12*a*,12*b* are preferably housed in a case 11. While in the disclosed embodiment the dispensing device 10 is constructed for use with two containers, the device is equally applicable for use with three or more containers. The dispensing device 10 is preferably attached to the containers 12*a*,12*b* by a snap-fit or other frictional engagement, whereby the dispensing device can be easily removed from one set of containers and removably attached to another set.

The containers 12*a*,12*b* may be any type of fluid containers, including aerosol containers of the piston type using a polyethylene, polypropylene, or a more sophisticated polymer barrier structure molded or thermoformed as a piston disposed between a propellant such as a hydrocarbon, compressed air (CAIR) or nitrogen, and a product to be dispensed. The containers 12*a*, 12*b* may also be of the so-called bag-in-can type having an inner container such as a bag or pouch that attaches to either of the top seam of the can or the can curl. Another type of bag-in-can system is one in which the bag is attached to the tailpiece of the valve. Such containers may comprise aluminum tri-laminate bags wrapped tightly to resemble cigars, pre-attached to the valve, and slipped into the empty can during valve-poking. One such can, the P-type bag-in-can system produced by Toyo Aerosol Industry Co., Ltd. of Japan, consists of a relatively thickwalled vertically fluted LPDE, HDPE, or laminated bag, the top area of which is made integral with a special nominal 22mm valve.

As will be appreciated by those of ordinary skill in the art, the containers 12*a*,12*b* are not limited to aerosol-type containers. For example, independent pump-type containers may also be used. Such containers usually have an overall cylindrical shape similar to that of an aerosol container and are provided with dispensing means in the form of a pump mechanism disposed at the top of the container. In pump-type containers, the product to be dispensed is not ejected through the nozzle of the pump by means of a propellant stored within the container, as in aerosol-type containers, but is ejected by means of the repeated pumping movement of a pump member located at the top of the container.

As should also be appreciated, any other type of fluid containers may be used with the dispensing device of the present invention, and the type, size, shape and geometry of the containers used in the preferred embodiments disclosed herein are neither critical nor essential aspects of the invention. While the applicator head assembly described herein is designed to accommodate a pair of cylindrical aerosol-type containers, this is not intended to limit the scope of the invention or the appended claims to any particular configuration.

The containers 12*a* and 12*b* have the same construction, though store different constituents. Therefore only one container will be described in detail, it being understood that the other container is of similar construction.

The containers 12*a* and 12*b* are of conventional construction and for explanatory purposes only and not by way of limitation, the invention will be described with reference to aerosol containers. As shown in FIGS. 1 and 3, the aerosol container 12*a* comprises a container body having a generally cylindrical sidewall 13, a closed lower end or bottom 14 and an upper end or top which is closed by a valve carrier cup 15. The valve carrier cup 15 is fixed by crimping or other means to the upper rim 16 of the container body.

The valve carrier cup 15 carries a valve or valve assembly 17 for dispensing the constituent within the container 12*a*. The valve 17 comprises a movable valve member 18 having a central axial throughbore 18*a* and a plurality of radial openings 18*b* for communicating the interior of the container 12*a* with the central throughbore 18*a* when the valve member 18 is depressed, as described in more detail hereinafter. The valve member 18 has a stepped configuration having a narrower upper portion which slidably projects upwardly through an opening in the valve carrier cup 15, and a wider lower portion which abuts against and seats on a valve seat 19 affixed to the valve carrier cup 15. The valve seat 19 surrounds the upper portion of the valve member 18 and is composed of a material suitable to maintain a fluidtight seal with the outer periphery of the valve member 18 while permitting repeated sliding movement of the valve member. A tubular support member 20 surrounds the lower portion of the valve member 18 and is fixed by bonding or other means to the valve seat 19 and/or to the valve carrier cup 15. Biasing means such as a compression spring 21 is disposed within the tubular support member 20 for normally urging the valve member 18 upwardly to its closed position (FIG. 3). The compression spring 21 is disposed in a compressed state between the lower end portion of the valve member 18 and an inner wall portion 20*a* of the support member 20. The lower end of the support member 20 has an axial throughbore 20*b* for permitting entry of the constituent into the interior of the tubular support member 20, from which the constitutent is ejected through the valve 17 to the dispensing device 10.

In operation, when the valve member 18 is depressed downwardly against the upward biasing force exerted by the compression spring 21, the radial openings 18*b* are brought into communication with the interior of the container 12*a* through the axial throughbore 20*b* and the interior of the tubular support member 20, thereby delivering the constituent from the container 12*a* through the axial throughbore 20*b* to the dispensing device 10 where the constituent is mixed with the constituent delivered from the other container 12*b*. When the depressing force is removed from the valve member 18, the compression spring 21 urges the valve member upwardly to its closed position shown in FIG. 3, wherein the radial openings 18*b* no longer communicate with the interior of the container 12*a*. If desired, radial openings (not shown) may also be provided in the sidewall of the tubular support member 20 upwardly of the wall portion 20*a* to facilitate the flow of the constituent to the radial openings 18*b* when the valve member 18 is depressed.

It will be understood by those ordinarily skilled in the art that any conventional type valve assembly can be employed for dispensing the constituents from the containers 12*a* and 12*b* in response to downward actuation. The valve assembly 17 and its associated structure have been described herein only by way of example and not by way of limitation.

The applicator head 25 is comprised of two complementary parts 26, 28, which are preferably molded of a relatively rigid opaque plastic material. The first part 26 is fitted directly onto the upper ends of the two containers 12*a*, 12*b* and carries a manually depressible actuator for discharging the constituents from the containers, and the second part 28 mates with the first part 26 and defines the mixing chamber and applicator.

The first part 26 comprises a base plate 30 delimited, when the first part 26 is in its fitted position on the containers 12*a*, 12*b*, by a bottom wall 32, a top wall 34 and a lateral sidewall 36. To the base plate 30 there is joined a peripheral skirt 38 having an inner wall 40 aligned with the lateral wall 36 and which is configured to receive the upper ends of the containers 12*a*, 12*b* and to mate with the case 11, the applicator head 25 thus being mounted for sliding engagement in relation to the case 11.

The inner wall 40 of the peripheral skirt 38 is provided with a flange 42 extending around the periphery of the inner wall 40. The flange 42 is designed to engage with an upper lip 44 of the containers 12*a*, 12*b* in a snap-fit engagement such that when the applicator head 25 is placed over the containers 12*a*, 12*b* and an adequate force is applied between the applicator head 25 and the containers 12*a*, 12*b*, the flange 42 engages the upper lip 44 of the containers 12*a*, 12*b* due to the resilient nature of the rigid plastic material forming the applicator head 25.

The bottom wall 32 of the first part 26 has two small cylindrical recesses 46*a*, 46*b* whose axes are perpendicular to the bottom wall 32. These recesses are positioned in such a way that when the applicator head 25 is mounted in position on the containers 12*a*, 12*b*, the upper ends of the valve members 18 of the containers 12*a*, 12*b* are snugly received in the respective cylindrical recesses 46*a*, 46*b*. Two inlet ducts 48*a*, 48*b* are formed in the first part 26, the ducts being bounded by the top and bottom walls 32 and 34. As shown in FIGS. 2 and 3, the two inlet ducts 48*a*, 48*b* communicate at one end with respective ones of the central throughbores 18*a* of the valve members 18, and merge together at their other ends and communicate with a common inlet port 49 leading to a mixing chamber 56.

In the top wall 34, a manually depressible actuator button 50 is provided to cause the base plate 30 to undergo downward movement with respect to the containers 12*a*, 12*b* to thereby downwardly displace the valve members 18 upon application of sufficient downward pressure to the actuator button 50 to simultaneously release the pressurized constituents from the respective containers 12*a*, 12*b*, as shown by the arrows in FIG. 3. Upon the release of downward pressure from the actuator button 50, the bias springs 21 of the valves 17 exert an upward force on the respective valve members 18 to close the valves 17 of the containers 12*a*, 12*b* and thereby stop the release of contents therefrom.

The second part 28 of the applicator head 25 may be fitted to the first part 26 by means of a frictional engagement. When the two parts 26, 28 of the applicator head 25 are fitted to each other, a rim portion 52 of the first part 26 engages with a peripheral ledge portion 54 of the second part to retain the first and second parts 26 and 28 in fitting engagement. In a preferred embodiment, the second part 28 is provided with an annular lip 55 which surrounds the ledge portion 54 and which frictionally engages with the rim portion 52 of the first part 26 to maintain the two parts 26 and 28 in operative engagement. If desired, an adhesive or other bonding agent can be applied to the mating surfaces of the rim portion 52 and ledge portion 54.

Figure 4:
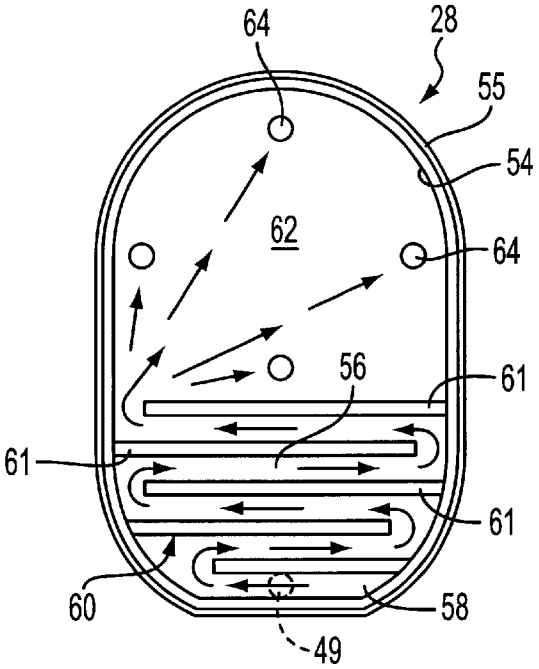
FIG. 4 is a view of the internal structure of the mixing chamber.

Referring now to FIG. 4, a view of the second part 28 can be seen in which the second part 28 has been removed from the first part 26 to illustrate the internal construction of the second part 28, namely, the construction of the internal mixing chamber 56 at which the two constituents ejected from the containers 12*a*, 12*b* are mixed. As noted above, the first part 26 is provided with two inlet ducts 48*a*, 48*b* for conveying the constituents from the respective containers 12*a*, 12*b* to the common inlet port 49. As illustrated in FIG. 4, the second part 28 has an inlet region 58 in alignment with the inlet port 49 of the first part 26, at which the individual flows from the inlet ducts 48*a*, 48*b* combine and are input to the mixing chamber 56. The mixing chamber 56 has a tortuous flow path defined by a baffle 60 for deflecting the constituents as they flow through the mixing chamber 56. The combined constituents enter the mixing chamber 56 at the inlet region 58 and flow along a sinuous path defined by the baffle 60 for a considerable distance, while undergoing repeated deflection by individual baffle members 61 of the baffle 60, to effect thorough mixing of the individual constituents. When the baffle 60 comprises multiple baffle members 61, the overlapping length of adjacent baffle members is greater than the non-overlapping length. The mixed constituent product ultimately reaches an open area 62 of the second part 28 at which it disperses and is ejected through the plural outlet ports 64. The path of flow of the individual constituents and the combined constituent product is illustrated by arrows in FIGS. 3 and 4.

The mixing chamber 56 thus comprises the opposed, confronting surfaces of the first and second parts 26 and 28 and the baffle 60 which, in this embodiment, is formed on the second part 28. After flowing completely through the sinuous path, the constituent mixture is ejected from the outlet ports 64 to provide a properly mixed composition without the need for the manual operations associated with prior art hair dye systems.

Although the baffle 60 is formed entirely on the second part 28 while the mating surface 66 of the first part 26 is smooth, all or part of the baffle 60 may instead be formed on the mating surface 66 of the first part 26, so long as when the first and second parts 26, 28 are fitted together in the manner described above, a mixing chamber is provided with an elongated tortuous flow path effective to assure proper mixing of the fluid constituents ejected from the first and second containers 12*a*, 12*b*.

Figure 5:
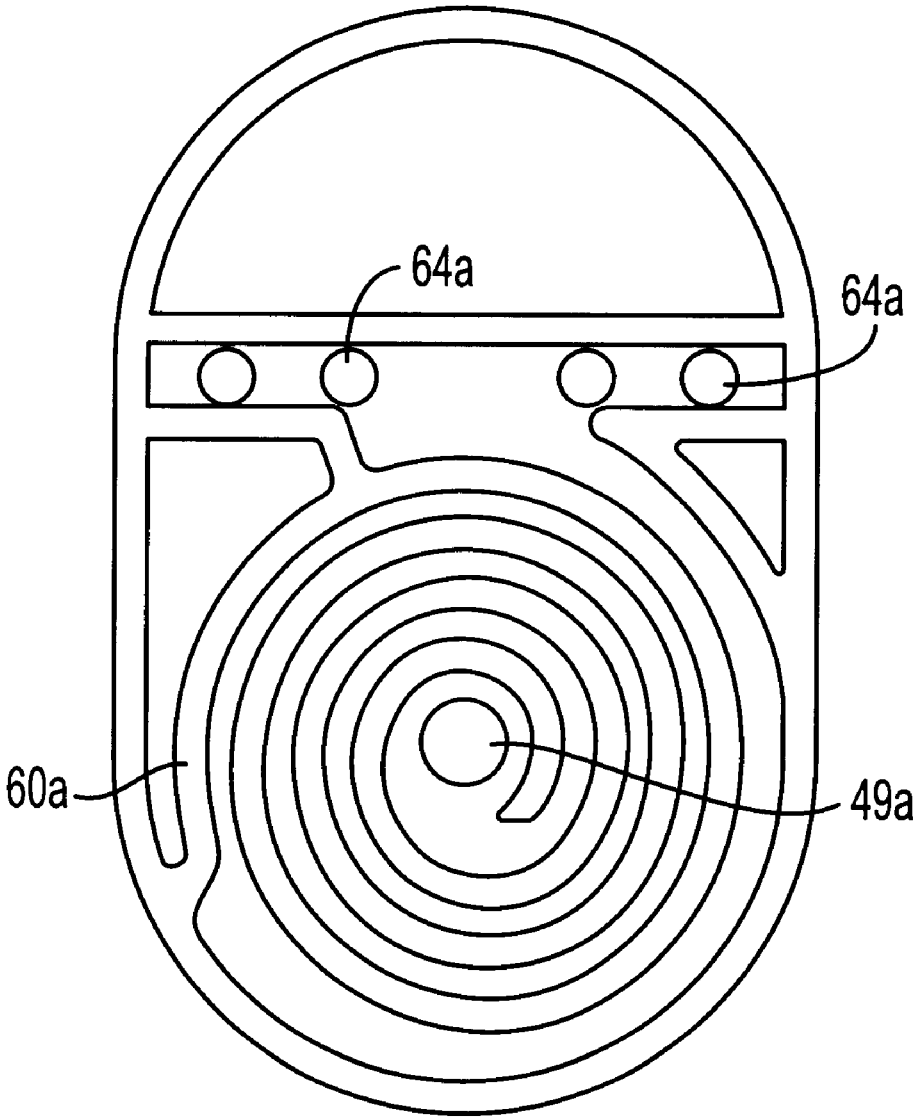
FIG. 5 is a view of the internal structure of a mixing chamber of an applicator head in accordance with a second preferred embodiment of the present invention.

Another embodiment of an internal structure of a mixing chamber is shown in FIG. 5. In this embodiment, the tortuous flow path has the configuration of a spiral path defined by a spiral baffle 60*a*. An inlet port 49*a* of the first part 26 opens at the center of the spiral path, and the two constituents ejected from the containers 12*a*, 12*b* combine at the inlet port 49*a* and intermix with one another as the constituents flow along the spiral flow path to outlet ports 64*a*.

Other baffle configurations will become apparent to those ordinarily skilled in the art to obtain a tortuous flow path effective to thorougly intermix the individual constituents during their combined flow through the mixing chamber.

As should also be appreciated, formation of the applicator head 25 in separable first and second parts 26 and 28 permits ease of manufacturing by means well known to those of ordinary skill in the art, such as by injection molding, thermoforming, or the like. This construction also permits simple cleaning of the inside of the applicator head 25. However, the applicator head may instead be formed of a single, unitary component, or may be formed of more than two separable components.

When the first and second parts 26 and 28 are fitted together in the manner described above, the inlet ducts 48*a*, 48*b*, mixing chamber 56, open area 62 and outlet ports 64 provide a path of continuous flow for the material ejected from the first and second containers 12*a* and 12*b*. This assists in preventing clogging of material and facilitates cleaning of the applicator head after use.

When the user desires to dispense a quantity of mixed product, he or she positions the applicator head 25 above the containers 12*a* and 12*b* with the respective valve stems 18 aligned with the recesses 46*a*, 46*b*. Then the applicator head and containers are brought towards one another until the flange 42 of the applicator head 25 engages the lips 44 of the containers 12*a*, 12*b*. Thereafter, the user depresses the actuator button 50 to simultaneously displace the two valve stems 18 downwardly to open the valves 17 and permit the constituents to be ejected from the containers 12*a* and 12*b* and flow through the inlet ducts 48*a*, 48*b* and the common inlet port 49 into the mixing chamber 56. After the two individual flows have come together, the mixing of the two flows is obtained in the chamber 56 before the combined product is ejected through the outlet ports 64 of the mixing chamber 56 to a comb portion 68, a detailed description of which is given below in conjunction with the description of the applicators shown in FIGS. 6–13. The comb portion 68 is then used to disperse and apply the ejected product throughout the hair. Thus, the steps of dispensing, mixing and applying a dual-agent hair dye are performed in a single operation using the apparatus of the present invention.

As will be appreciated by those of ordinary skill in the art, a multitude of fluid constituents of differing viscosities, flow rates, densities and other characteristics may be accommodated in the multi-container dispensing system of the present invention to achieve a desired combined product by means of mixing. Products such as oils, epoxies, cleaning fluids, and the like, may be used. Similarly, hair treatment products other than dyes may be used, including products intended for human and animal use such as relaxers, straighteners, conditioners, and formulae intended to treat scalp conditions and other problems such as hair lice, fleas, and the like. In order to accommodate constituents of differing flow characteristics, various modifications may be made within the scope and spirit of the present invention, such as by varying the size or type of the containers, varying the size or length of the inlet ducts, mixing chamber, or outlet ports, varying the applicator structure or fluid passageways to accommodate a particular product or application, and the like.

In accordance with another aspect of the invention, an applicator is provided for dispensing and applying a fluid product. The applicator may be used for dispensing single constituent products from one source or pre-mixed constituent products from multiple sources.

The applicator is a portable hand-held unit which, during use, is connected to a source of product to be dispensed. The applicator may be of the same or similar construction as the applicator heads described above, and the mixing chamber may be omitted from the applicator heads if no mixing of products is desired. In such a case, the applicator head 25 would be modified to provide a coupling or connector at the region of the inlet port 49 to enable connection of the applicator to a source of product to be dispensed. The baffle 60 may be omitted to provide less obstruction to the flow of product.

Figure 8:
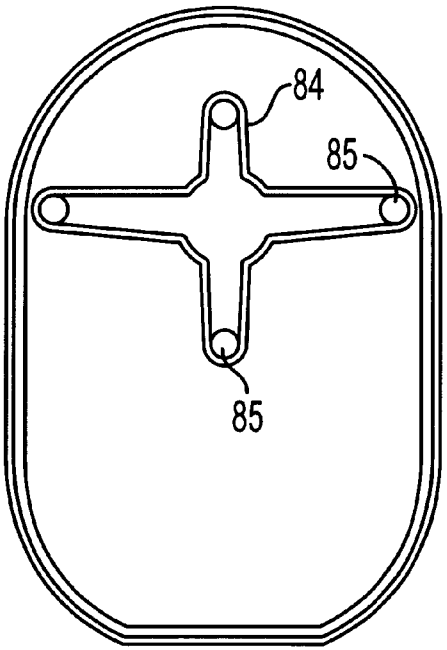
FIG. 8 is a rear view of the applicator of FIG. 7, with the back plate removed to show the fluid ports and passageways.
Figure 7:
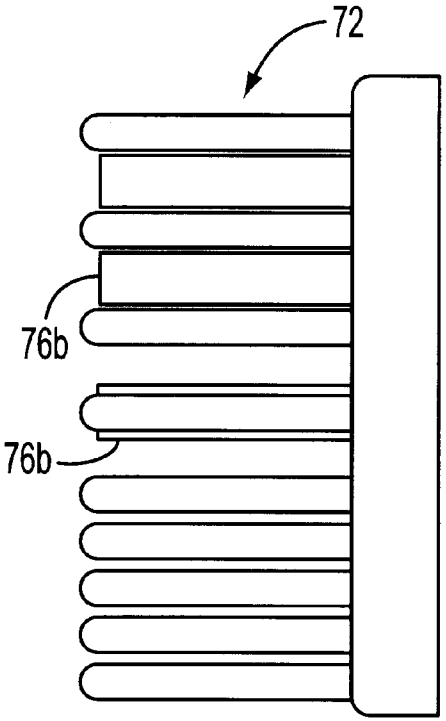
FIG. 7 is a side view, with back plate removed, of the applicator of FIG. 6.
Figure 6:
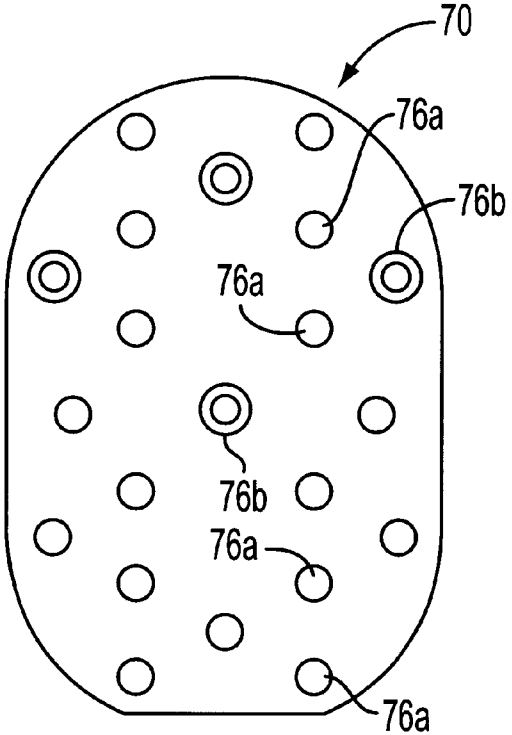
FIG. 6 is a front view of one embodiment of an applicator.
Figure 10:
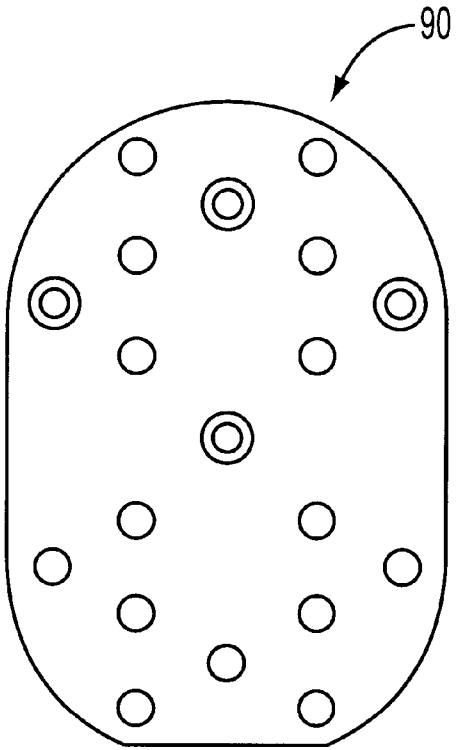
FIG. 10 is a front view of another embodiment of an applicator.
Figure 9:
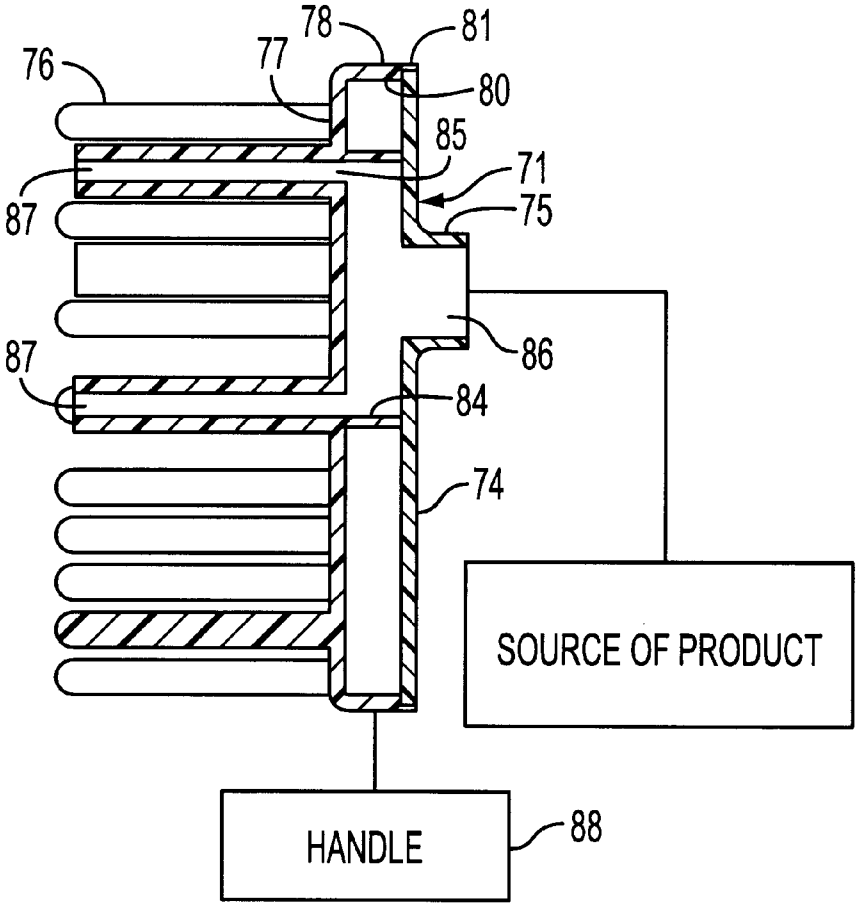
FIG. 9 is a cross-sectional view of the applicator of FIG. 6, with the back plate attached, and showing the applicator with a handle and connected to a source of product to be dispensed.
Figure 11:
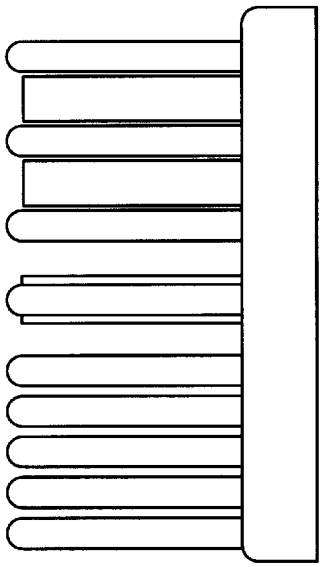
FIG. 11 is a side view, with back plate removed, of the applicator of FIG. 10.
Figure 12:
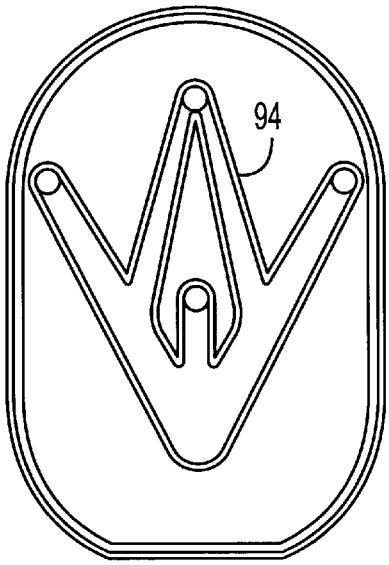
FIG. 12 is a rear view of the applicator of FIG. 11, with the back plate removed to show the fluid ports and passageways.
Figure 13:
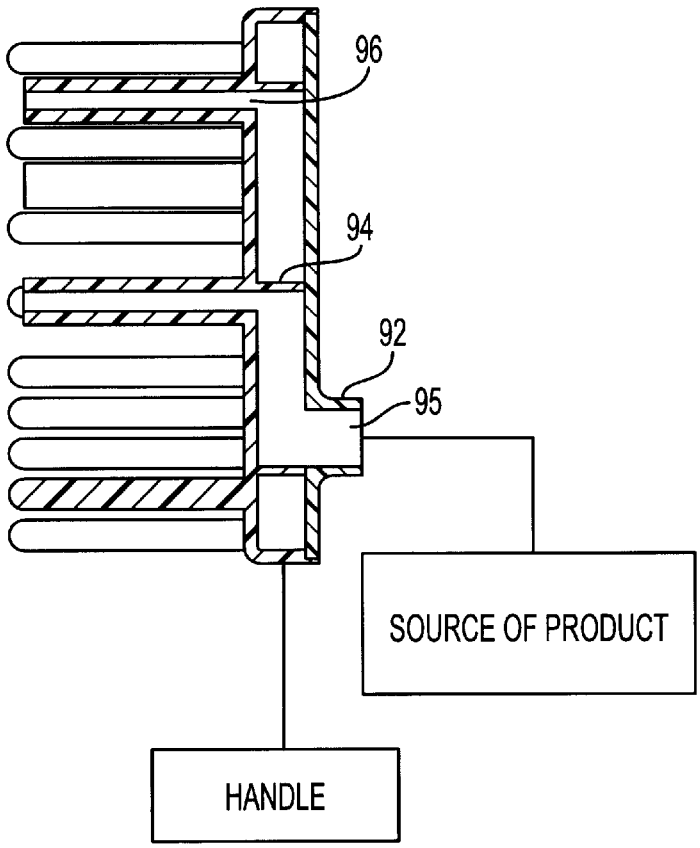
FIG. 13 is a cross-sectional view of the applicator of FIG. 10, with the back plate attached, and showing the applicator with a handle and connected to a source of product to be dispensed.

One embodiment of an applicator 70 according to the present invention is shown in FIGS. 6–9. The applicator 70 comprises a portable hand-held unit having a base portion 71 and comb portion 72, the comb portion 72 being the same as the comb portion 68 shown in FIGS. 1–4 insofar as concerns the structure and function of the teeth or tines. As shown in FIG. 9, the base portion 71 comprises a base plate 74 and a coupling or connector 75 for enabling removable connection of the applicator 70 to a dispensable source of product. The coupling or connector 75 may have threads or other fastening elements which mate with complementary fastening elements on a conduit connected to the outlet of the source of the product.

The comb portion 72 comprises a plurality of teeth or tines 76 arranged in any desired configuration and projecting outwardly from a front face of the comb portion 72. The teeth or tines 76 (hereafter referred to as simply tines) consist of solid tines 76*a* and hollow tines 76*b* in this embodiment, the hollow tines 76*b* having a slightly shorter length than the solid tines 76*a*. As shown in FIG. 9, the comb portion 72 has a front support wall 77 to which are connected the tines 76 and a peripheral side wall 78 connected to the front wall 77. The rear edge of the side wall 78 has an annular recess defined by a ledge 80 and a lip 81 for receiving therein, preferably with a snap-fit, the base plate 74. A suitable bonding agent, such as an adhesive or the like, may be applied to the mating surfaces of the base plate 74 and the ledge 80 to permanently connect the base portion 71 to the comb portion 72.

As shown in FIGS. 8 and 9, a partition wall 84 is provided on the rear face of the front wall 77. The partition wall 84 surrounds outlet openings 85 which open into the hollow tines 76*b*, and the partition wall 84 is configured to surround a central inlet opening 86 defined by the connector or coupling 75 when the base portion 71 is fitted to the comb portion 72. The partition wall 84 defines flow passages for the product to be dispensed, guiding the product from the inlet opening 86 to the outlet openings 85 so that the product flows through the hollow tines 76*b* and is discharged from outlet ports 87 at the distal ends thereof.

The applicator 70 is configured to be held by the hand of a user and manipulated in the same manner as a brush or comb. If desired, a handle 88 may be attached to the applicator 70 to facilitate use thereof. In operation, a source of product to be dispensed is connected by means of a conduit or the like to the connector or coupling 75. The user grasps the applicator 70, or the handle 88, and positions the applicator in proximity to a person's hair which is to be treated. The user then discharges the product from the source, whereupon the product flows through the inlet opening 86 into a receiving chamber defined by the partition wall 84. The product is guided by the partition wall 84 and flows through the outlet openings 85 and through the hollow interiors of the hollow tines 76*b*. The product is discharged from the outlet ports 87 at the distal ends of the hollow tines 76*b* onto the person's hair while the applicator 70 is manipulated to apply the product, as desired, by means of the tines 76. The shorter length of the hollow tines 76*b* facilitates dispensing of the product while enabling the longer tines 76*a* to penetrate deeper through the person's hair to enable the product to be easily applied while it is being dispensed. Of course, the shorter tines 76*b* also assist in applying the product in conjunction with the longer tines 76*a*.

FIGS. 10–13 show another embodiment of an applicator 90, which is similar to the applicator 70 shown in FIGS. 6-9 except for the location of the coupling or connector and the arrangement of the partition wall. In this embodiment, a coupling or connector 92 is located near the bottom of the applicator 90, and a partition wall 94 is configured to provide flow passages for directing the product from an inlet opening 95 to inlet openings 96 of the hollow tines. In other respects, the applicator 90 is similar to the applicator 70.

Obvious changes and modifications will become apparent to those of ordinary skilled in the art. For example, the partition wall may be eliminated and the product permitted to flow freely into the space between the comb portion and the base portion. The array of tines may be varied, and the number of hollow tines and/or solid tines may be varied, as well as varying the length of the tines. similarly, the configuration of the applicator may take any shape. The comb portion and base portion are preferably molded of plastic, though may be formed of other suitable materials. The partition wall may be formed on the base portion rather than the comb portion, or on both portions, or the partition wall may be eliminated entirely.

Obvious modifications and changes may be made to the embodiments described herein, and the present invention is intended to cover all such obvious modifications and changes which fall within the spirit and scope of the appended claims.

What is claimed is:

1. A dispensing device mountable in use atop a plurality of independently valved containers containing dispensable constituents which are dispensed upon actuation of the container valves, the dispensing device comprising:

a mixing chamber for mixing together the constituents dispensed from the containers to form a mixed product and for outputting the mixed product through plural outlet ports, wherein the mixing chamber has an inlet port for admitting the constituents dispensed from the containers into the mixing chamber, and an elongated tortuous flow path having one end in fluid communication with the inlet port and another end in fluid communication with the plural outlet ports, the tortuous flow path being effective to thoroughly intermix the constituents during flow thereof from the inlet port through the tortuous flow path to the outlet ports, wherein the tortuous flow path is defined by at least one of (a) a baffle defining a spiral flow path; or (b) a baffle defining a sinuous flow path, said baffle comprising at least two baffle members which overlap over a majority of their respective lengths;

an applicator having a plurality of tines at least some of which are hollow, the hollow tines being in fluid communication with respective outlet ports of the mixing chamber for dispensing from distal ends thereof the mixed product, and an actuator for simultaneously actuating the container valves.

2. A dispensing device according to claim 1; wherein the plurality of tines comprise hollow tines in fluid communication with respective outlet ports of the mixing chamber, and solid tines coacting with the hollow tines for spreading the dispensed mixed product.

3. A dispensing device according to claim 2; wherein the hollow tines are shorter in length than the solid tines.

4. A dispensing device according to claim 1; wherein the elongated tortuous flow path has a sinuous shape.

5. A dispensing device according to claim 1; wherein the elongated tortuous flow path has a spiral shape.

6. A dispensing device according to claim 1; wherein the mixing chamber and the applicator are formed of two parts fitted together.

7. A dispensing device according to claim 6; wherein the two parts have opposed spaced-apart surfaces defining the mixing chamber.

8. A dispensing device according to claim 7; wherein the baffle extends outwardly from one of the opposed surfaces of one of the two parts and engages the other opposed surface of the other of the two parts.

9. A dispensing device according to claim 7; wherein the baffle defines a spiral flow path communicating with the inlet port at the center thereof and communicating with the outlet ports at the outer end thereof, whereby the constituents admitted through the inlet port undergo thorough intermixing during the flow along the spiral flow path to the outlet ports.

10. A dispensing device according to claim 6; wherein the acutator is formed as one of the two parts.

11. A dispensing device mountable in use atop a plurality of independently valved containers containing dispensable constituents which are dispensed upon actuation of the container valves, the dispensing device comprising:

a mixing chamber for mixing together the constituents dispensed from the containers to form a mixed product, and an applicator having at least one outlet port and at least one channel defining a flow path for directing fluid from the mixing chamber to the at least one outlet port, wherein the mixing chamber has at least one inlet port for admitting the constituents dispensed from the containers into the mixing chamber, and an elongated tortuous flow path having one end in fluid communication with the at least one inlet port and another end in fluid communication with the applicator; the tortuous flow path being effective to thoroughly intermix the constituents during flow thereof through the tortuous flow path, wherein the tortuous flow path is defined by at least one of (a) a baffle defining a spiral flow path, or (b) a baffle defining a sinuous flow path, said baffle comprising at least two baffle members which overlap over a majority of their respective lengths.

12. A dispensing device according to claim 11, wherein the elongated tortuous flow path has a sinuous shape.

13. A dispensing device according to claim 11, wherein the baffle defines a spiral flow path.

14. A dispensing device according to claim 11, further comprising an actuator for simultaneously actuating the container valves.

15. A dispensing device mountable in use atop a plurality of independently valved containers containing dispensable constituents which are dispensed upon actuation of the container valves, the dispensing device comprising:

a mixing chamber having at least one inlet duct for admitting the constituents dispensed from the containers, and an elongated tortuous flow path having one end in fluid communication with the at least one inlet duct, the tortuous flow path being effective to thoroughly intermix the constituents to form a mixed product, wherein the tortuous flow path is defined by at least one of (a) a baffle defining a spiral flow path, or (b) a baffle defining a sinuous flow path, said baffle comprising at least two baffle members which overlap over a majority of their respective lengths; and an applicator admitting the mixed product from the mixing chamber having at least one outlet port.

16. A dispensing device mountable in use atop a plurality of independently valved containers containing dispensable constituents which are dispensed upon actuation of the container valves, the dispensing device comprising:

means for deflecting the constituents together during flow to form a mixed product, means for dispensing the mixed product through at least one external outlet, means for conveying the constituents from each of the independently valved containers to said deflecting means, and means for conveying the mixed product from said deflecting means to said dispensing means, wherein the deflecting means comprises a mixing chamber having an elongated tortuous flow path effective to thoroughly intermix the constituents said tortuous flow path defined by at least one of (a) a baffle defining a spiral flow path; or (b) a baffle defining a sinuous flow path, said baffle comprising at least two baffle members which overlap over a majority of their respective lengths.

17. A dispensing device according to claim 16, wherein the elongated tortuous flow path has a sinuous shape.

18. A dispensing device according to claim 16, wherein the elongated tortuous flow path has a spiral shape.

19. A dispensing device according to claim 16, further comprising means for simultaneously actuating the container valves.

20. The dispensing device of claim 16, wherein the dispensing means comprises a plurality of external outlets.

21. A method of dispensing a mixed product from a plurality of independently actuatable containers comprising:

conducting separate product from each individual container, mixing the separate product by repeated deflection in a mixing chamber to form the mixed product, and conducting the mixed product to at least one outlet port, wherein the mixing chamber comprises a tortuous flow path defined by at least one of (a) a baffle defining a spiral flow path: or (b) a baffle defining a sinuous flow path, said baffle comprising at least two baffle members which overlap over a majority of their respective lengths.

* * * * *